US006094903A

United States Patent [19]

Aellen

[11] Patent Number: 6,094,903

[45] Date of Patent: Aug. 1, 2000

[54] WATCH BAND

[75] Inventor: Pierre-André Aellen, Le Landeron, Switzerland

[73] Assignee: Braloba AG, Biel, Switzerland

[21] Appl. No.: 08/952,073

[22] PCT Filed: May 13, 1996

[86] PCT No.: PCT/CH96/00184

§ 371 Date: Nov. 17, 1997

§ 102(e) Date: Nov. 17, 1997

[87] PCT Pub. No.: WO96/36250

PCT Pub. Date: Nov. 21, 1996

[30] Foreign Application Priority Data

May 15, 1995 [CH] Switzerland ..... 1402/95

[51] Int. Cl.[7] ..... F16G 15/00

[52] U.S. Cl. ..... 59/82; 59/80; 59/900

[58] Field of Search ..... 59/78, 80, 82, 59/900

[56] References Cited

U.S. PATENT DOCUMENTS 3,837,163 9/1974 Fujimori .

FOREIGN PATENT DOCUMENTS

| | | | |
|---|---|---|---|
| 0165206 | 12/1985 | European Pat. Off. . | |
| 2562398 | 10/1985 | France | 59/82 |
| 2693355 | 1/1994 | France . | |
| 2040343 | 3/1971 | Germany . | |
| 530768 | 11/1972 | Switzerland . | |
| 582432 | 11/1946 | United Kingdom . | |
| 8503417 | 8/1985 | WIPO | 59/82 |

*Primary Examiner*—David Jones
*Attorney, Agent, or Firm*—Oblon, Spivak, McClelland, Maier & Neustadt, P.C.

[57] ABSTRACT

The links of the watch-band have a middle bar, two outer extensions adjoining on the one side thereof and two inner extensions on the opposite side. The extensions are provided with bores. To join together two links, a rod is led through the bores of the outer extensions of a first link and the bores of the inner extensions of a second link. Located between the inner extensions and the inner and outer extensions are rubber rings, which hold the rod. Thus, the bores in the extensions do not have to be made precisely, which leads to a significant reduction in the manufacturing costs of the metal watch-band.

19 Claims, 4 Drawing Sheets

WATCH BAND

BACKGROUND OF THE INVENTION

This invention relates to a watch-band with a plurality of links detachably linked together, the links having a middle part which on the one side is provided with at least one first extension, forming a female part, and on the other side with at least one second extension, forming a male part, for receiving a connecting element, the first and second extensions having bores. The manufacture of the initially mentioned watch-bands of metal, particularly of steel, known so far entails relatively high costs since the bores in the extensions of the watch-band links as well as the connecting element, designed as a rod holding together two successive links, must be manufactured with great precision. The rod has to be held very securely through the bores in the extensions.

SUMMARY OF THE INVENTION

It is the object of the present invention to create a metal watch-band which can be manufactured with considerably lower manufacturing costs than the known metal watch-bands of the state of the art. The bores in the extensions of the watch-band links as well as the connecting element should not have to be manufactured very precisely. Moreover, in contrast to the subject matters of U.S. Pat. No. 3,837,163, of French Patent No. 2 693 355 and of German Patent No. 2 040 343, an additional aesthetic effect should be attained. This is achieved, according to the invention, in that in the area in which the female part and the male part of two links overlap at least one visible elastic element is provided between the extensions for holding the connecting element.

BRIEF DESCRIPTION OF THE DRAWINGS

Example embodiments of the invention and their application will be explained more closely in the following description with reference to the attached drawings. Shown are.

DETAILED DESCRIPTION OF THE PREFERRED EMBODIMENTS

Figure 1:
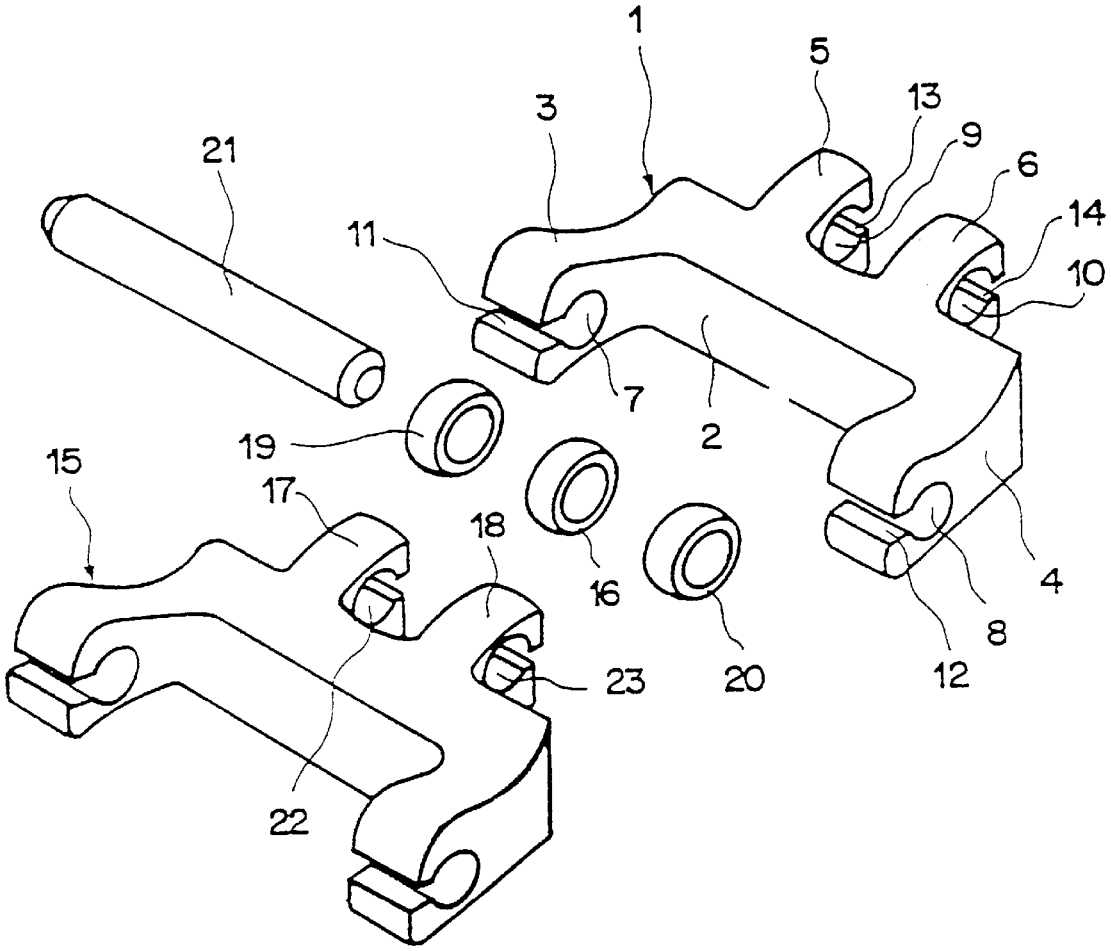
FIG. 1, two links of a first example embodiment of the metal watch-band with the pin and the rubber rings for connection of the links.

Referring to FIG. 1, each; link 1 of the metal watch-band, except the two which are fastened to the watch, has a central middle bar 2 and two outer extensions 3 and 4 adjoining outside thereon, running approximately perpendicular to the middle bar 2, which form the female part. On the side opposite the outer extensions 3 and 4, the middle bar 2 is provided with inner extensions 5 and 6, which form the male part. The outer extensions 3 and 4 as well as the inner extensions 5 and 6 are provided in their outer area with bores 7, 8, 9, 10 running parallel to the middle bar 2. Adjoining the bores 7, 8, 9 and 10 are slots 11, 12, 13, 14. The second link

15 is designed the same way as the first link 1. To connect the two links 1 and 15, a rubber ring 16 is placed between the inner extensions 17 and 18 of the second link 15. Two rubber rings 19 and 20 are placed laterally on the extensions 17 and 18, the link 15 being fixed to the link 1 in such a way that the inner extensions 17 and 18 of the second link 15 are situated between the outer extensions 3 and 4 of the first link 1, and the links partially overlap in the horizontal plane when viewed from above. Then a cylindrical metal pin 21 is pushed through the bore 7 in the outer extension 3, through the rubber ring 19, through a hole 22 in the inner extension 17 of the second link 15, through the rubber ring 16, through a hole 23 in the inner extension 18 of the second link 15, through the rubber ring 20 and through the bore 8 in the outer extension 4 of the first link 1. By of this configuration it is made possible that the bores 7, 8, 9 and 10 in the outer and inner extensions of a watch-band link do not have to be made precisely. They do not have to be cylindrical and can vary in diameter. The pin 21, which acts as a pivot axis between the two links 1 and 15, is held by the rubber rings 16, 19 and 20. The inner diameters of the hollow-cylinder-shaped rubber rings 16, 19 20 are somewhat smaller than the outer diameter of the pin 21. This pin likewise need not be precisely manufactured. The costs of manufacture of the metal watch-band, which is preferably made of steel, can thereby be reduced by about 50%.

The rings 16, 19, 20 can be made of rubber, a rubber-like material, caoutchouc rubber or the like.

Figure 2:
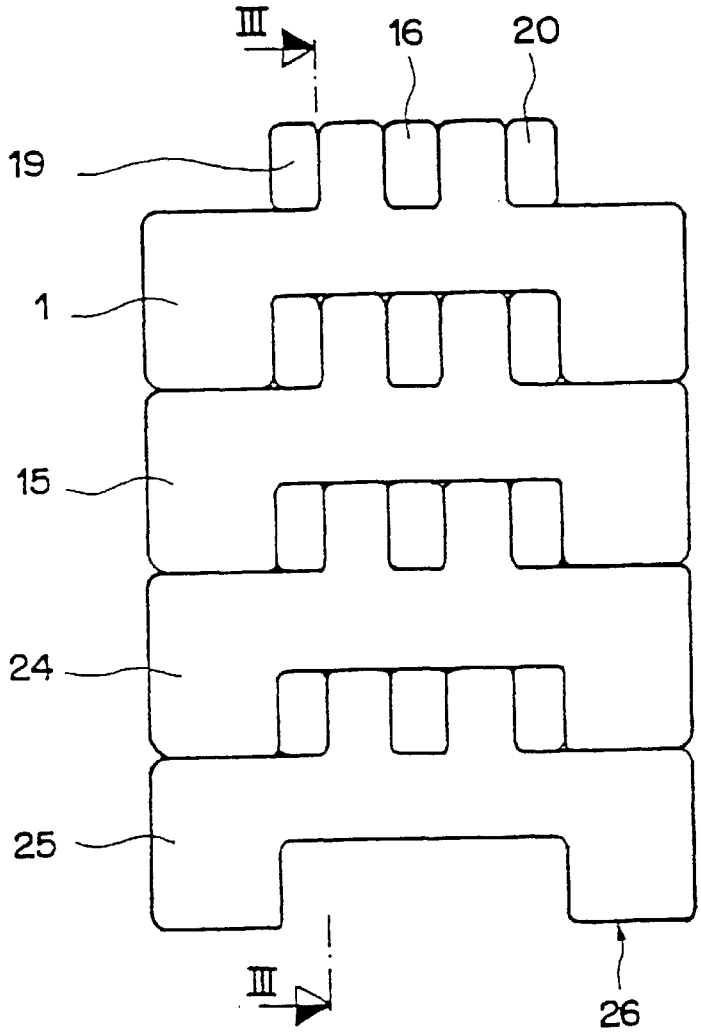
FIG. 2, a top view of four assembled links of the watch-band.

FIG. 2 shows a top view of a part 26 of a watch-band composed of four links 1, 15, 24 and 25 according to the first embodiment example.

Figure 3:
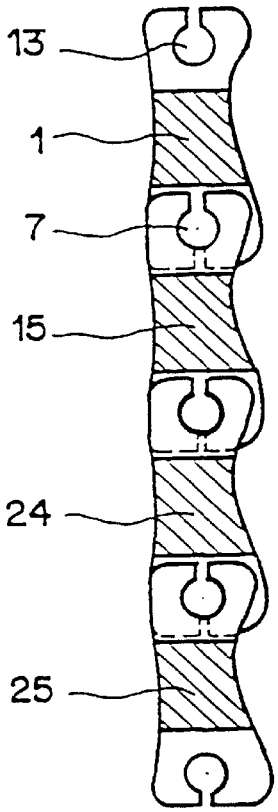
FIG. 3, a section along line III—III of FIG. 2.

FIG. 3 shows a section along line III—III of FIG. 2.

Figure 4:
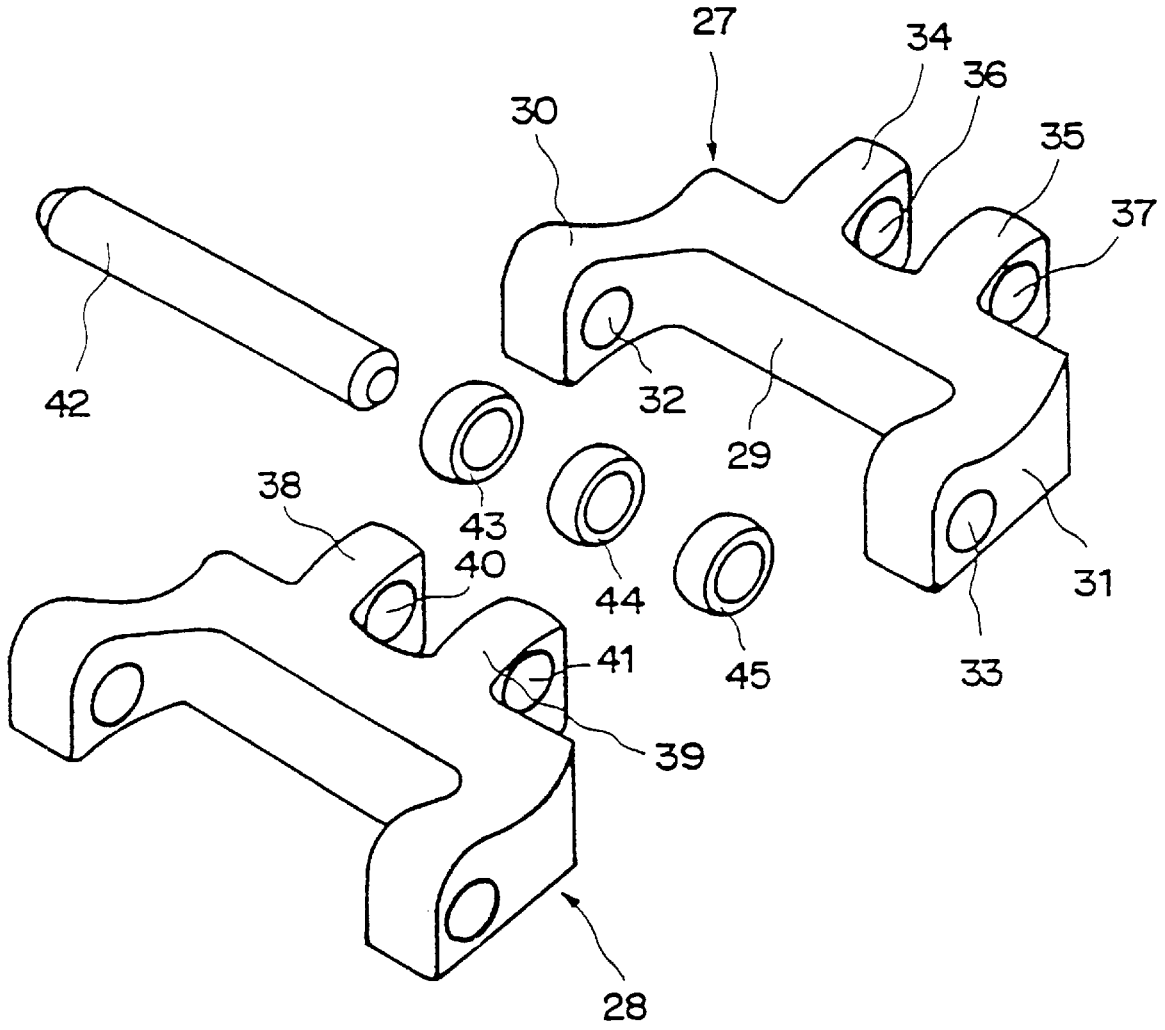
FIG. 4, two links of a second embodiment example of the metal watch-band with the pin and the rubber rings for connection of the links.
Figure 5:
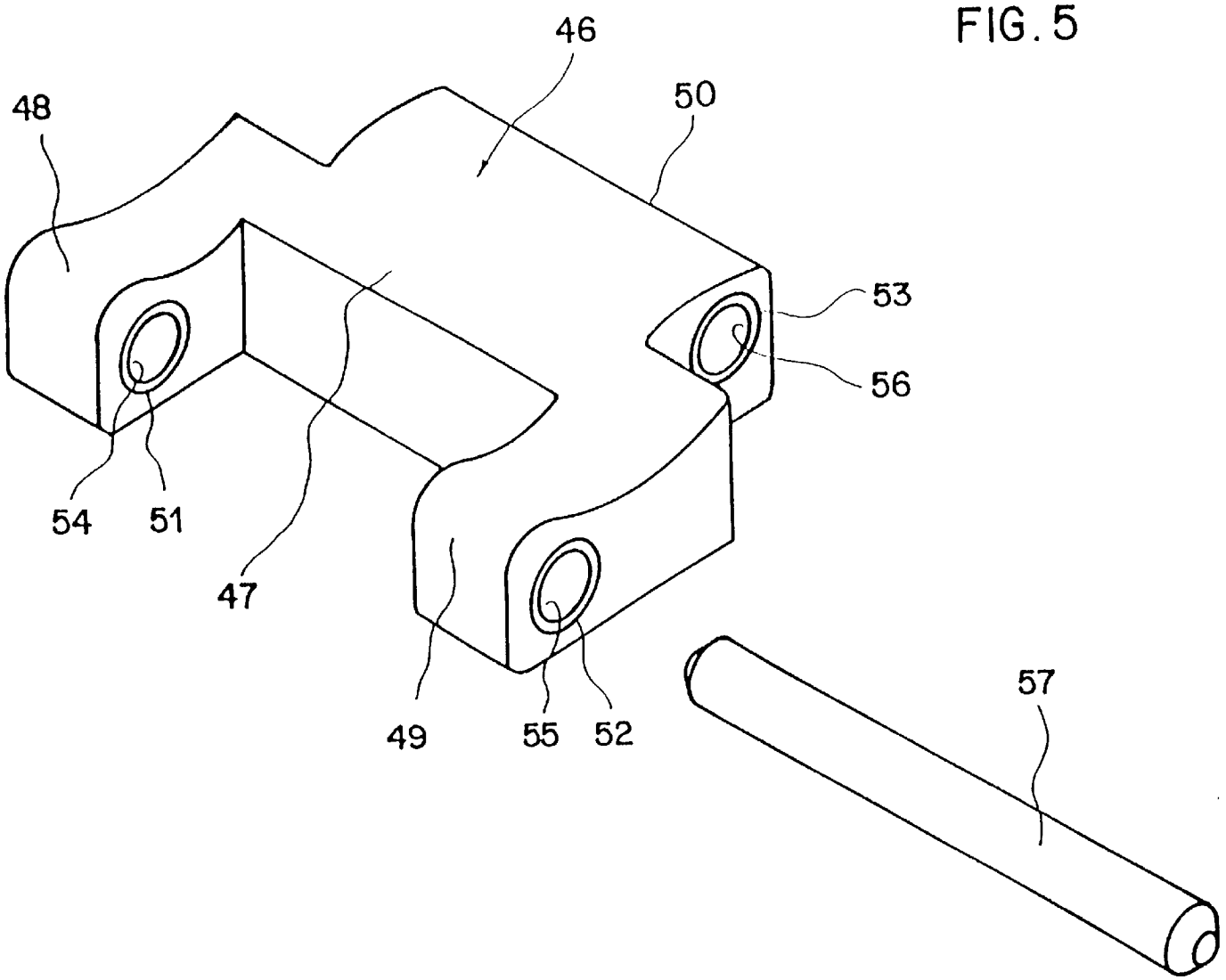
FIG. 5 shows in perspective a view of a link according to a second embodiment.

FIG. 4 shows in perspective view two links 27 and 28 of a second embodiment example of a metal watch-band. The first link 27 likewise comprises, as in the first embodiment example, a middle bar 29, two outer extensions 30 and 31 adjoining thereon on one side. On the side of the middle bar 29 opposite the outer extensions 30 and 31, two inner extensions 34 and 35 are foreseen, which each have a bore 36 and 37 running parallel to the middle bar 29. The outer extensions 30 and 31 are provided in their outer areas with one bore each 32 and 33 running parallel to the middle bar 29. The second link 28 likewise has, in addition to the outer extensions, two inner extensions 38 and 39, which are provided with bores 40 and 41. The two links 27 and 28 are put together with the pin 42 and the rubber rings 43, 44 and 45 in the same way as in the first embodiment example. The inner diameters of the hollow-cylinder-shaped rubber rings 43, 44, 45 are somewhat smaller than the outer diameter of the pin 42.

Except for those connected to the watch itself, the links of the watch-band are identical, as in the first embodiment example. In the second embodiment example, the extensions have only bores without slots. The rings 43, 44, 45 are made of the same material as in the first embodiment example according to FIG. 1.

In a third embodiment example, not shown in the drawing, the link of the metal watch-band is in principle designed the same as in the first embodiment example, however the inner extensions of the male part are situated somewhat further apart, so that, when putting together the links of the watch-band, they almost touch the outer extensions of the female part. In this case, only one hollow-cylinder-shaped elastic member is provided per link, between the inner extensions of the male part through which the metal rod is pushed.

An aesthetic effect can be achieved with the embodiment according to FIG. 1 and FIG. 4 if rubber rings of varying colors are used.

I claim:

1. Watch-band comprising a plurality of links detachably linked together, said links each having a middle part which on one side is provided with at least two outer first extensions forming a female part and on an opposite side is provided with at least one inner second extension forming a male part, said extensions receiving a connecting element and having bores therethrough, wherein, in an area between the two first extensions of the female part where the female part and the male part of two links are interconnected, there are at least two elastic elements between the extensions for holding the connecting element.

2. Watch-band according to claim 1, characterized in that the middle part of each link is provided on the opposite side with two inner second extensions forming the male part.

3. Watch-band according to claim 2, characterized in that, provided in the interconnected area of two links, there is at least one elastic element between the inner extensions of a second of the two links and at least two elastic elements between the outer extensions of a first of the two links.

4. Watch-band according to claim 3, characterized in that the elastic elements are hollow cylinders.

5. Watch-band according to claim 3, characterized in that the connecting element is a cylindrical rod.

6. Watch-band according to claim 2, characterized in that the elastic elements are hollow cylinders.

7. Watch-band according to claim 2, characterized in that the connecting element is a cylindrical rod.

8. Watch-band according to claim 2, characterized in that on of at least two elastic elements is provided between the two inner extensions forming the male part.

9. Watch-band according to claim 8, characterized in that the elastic elements are hollow cylinders.

10. Watch-band according to claim 4, characterized in that the connecting element is a cylindrical rod.

11. Watch-band according to claim 1, characterized in that the middle part of each link is provided on the one side with only two outer extensions, forming the female part and on the opposite side with only one inner extension forming the male part.

12. Watch-band according to claim 11, characterized in that the elastic elements are hollow cylinders.

13. Watch-band according to claim 11, characterized in that the connecting element is a cylindrical rod.

14. Watch-band according to claim 1, characterized in that the connecting element is a cylindrical rod.

15. Watch-band according to claim 1, characterized in that an inner diameter of each of the elastic elements is smaller than an outer diameter of the connecting element.

16. Watch-band according to claim 15, characterized in that the connecting element is a cylindrical rod.

17. Watch-band according to claim 1, characterized in that the links and the connecting element are all made of steel.

18. Watch-band according to claim 17, characterized in that the connecting element is a cylindrical rod.

19. Watch-band according to claim 1, characterized in that the elastic elements are hollow cylinders.

* * * * *